United States Patent [19]

Sitterer et al.

[11] 4,000,672

[45] Jan. 4, 1977

[54] SLITTING MACHINE FOR CORRUGATED PIPE

[75] Inventors: Theodor K. Sitterer, Glen Cove, N.Y.; Siegfried Valentin, Chester, N.J.

[73] Assignee: Altair National Corporation, Central Islip, N.Y.

[22] Filed: Feb. 26, 1976

[21] Appl. No.: 661,644

[52] U.S. Cl. ..... 83/203; 83/54; 83/209; 83/221; 83/236; 83/278; 83/283; 83/367; 83/484; 83/488

[51] Int. Cl.[2] ..... B26D 5/20

[58] Field of Search ..... 83/203, 54, 205, 209, 83/221, 236, 278, 283, 367, 484, 488

[56] References Cited

UNITED STATES PATENTS 3,831,470 8/1974 Maroschak ..... 83/54 X

*Primary Examiner*—Frank T. Yost

*Attorney, Agent, or Firm*—John M. Montstream

[57] ABSTRACT

A slitting machine is disclosed which feeds corrugated pipe through the machine intermittently and between the periods of pipe feeding when the pipe is stationary a plurality of angularly spaced saw sets are moved radially inward toward the machine axis and the pipe to cut slots through the wall thereof, and then withdrawn whereupon the cycle repeats. The pipe is fed through the machine by endless transporters equal in number to the saw sets and uniformly disposed angularly with respect to each other, the saw sets and the axis. The transporters have projections which fit into the corrugations of the pipe for a driving connection therewith. A saw set is located angularly between each pair of transporters so that a pair of the latter are roughly opposite to a saw set for an even number of sets or directly opposite a transporter for an odd number of sets. This arrangement backs up the pipe when it is being cut so that the number of saws in each set or gang can be increased and thereby increase the length of pipe which can be slitted for each cycle and increase the number of feet per minute of pipe which can be cut. For a machine having an even number of saw sets, half are driven in one direction of rotation and half in the other direction in order to eliminate torque on the pipe when cutting. For a machine having an odd number of saw sets there will be one more set of saws rotating in one direction than in the other direction to reduce the torque on the pipe when cutting. Control means are provided to set each operation into motion and preferably automatically and to assure also that each operation is completed before the other is initiated.

23 Claims, 9 Drawing Figures

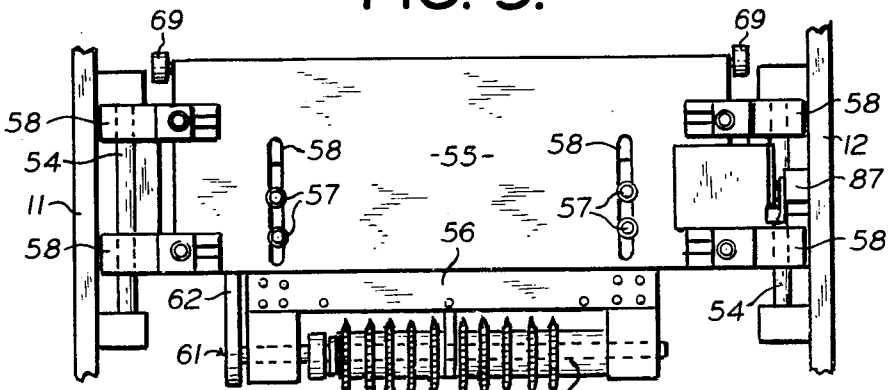
FIG. 5.
FIG. 9.
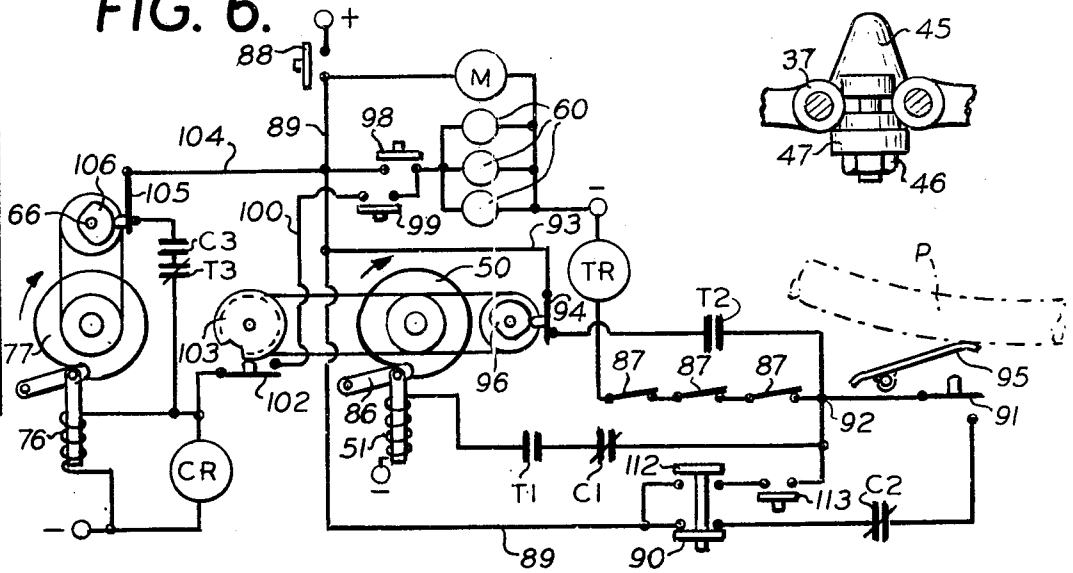
FIG. 6.
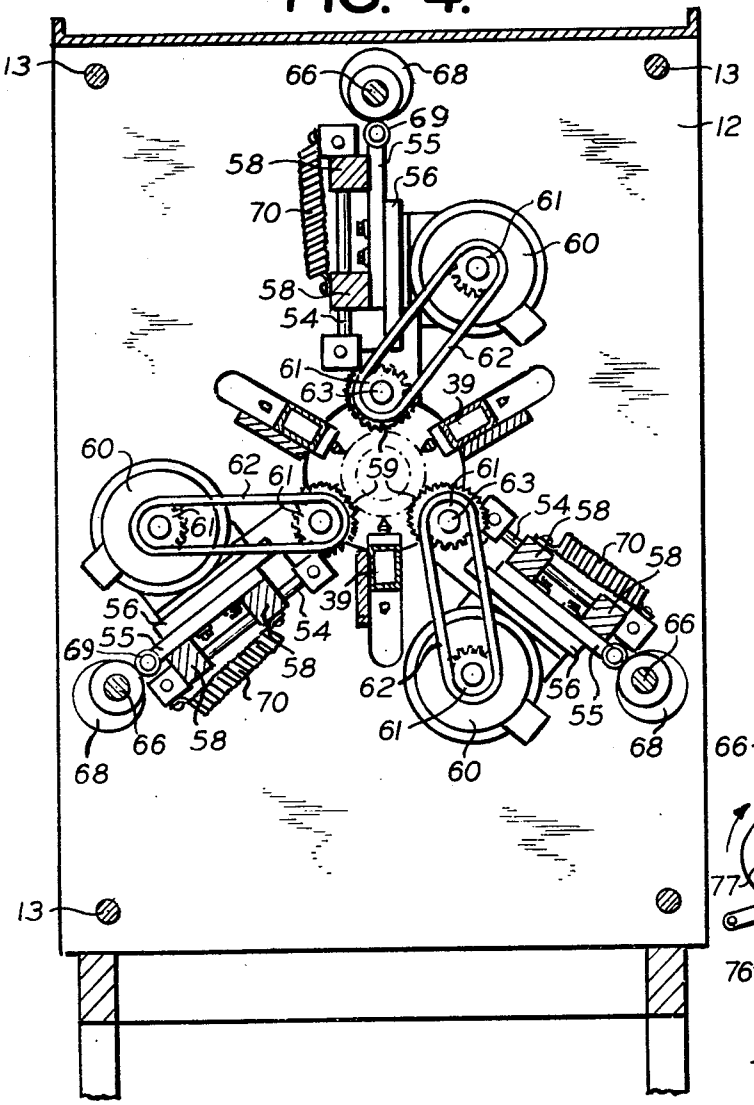
FIG. 4.

SLITTING MACHINE FOR CORRUGATED PIPE

Plastic corrugated pipe has many uses including service as a drain pipe for which service slits are required through the pipe wall. Such slits are cut into the pipe by saws and are usually located circumferentially of the pipe and in the groove of the corrugation. The slitting machine herein feeds the pipe intermitantly and the slitting takes place when the pipe is stationary. The transporting means which feeds the pipe includes at least two endless transporters or chains at sawing spaced uniformly angularly with respect to each other so that the pipe is supported thereby at the sawing position and also the saws are located between each pair of transporting chains so that the saws are backed up on the opposite side of the pipe by a transporting chain or chains for a machine having three or more transporters or by a suitable pipe guide for a machine having two transporters. The machine particularly illustrated has three transporting chains and three sets of cutting saws.

An object of the invention is to provide transporting means for the pipe at sawing position angularly disposed uniformly around the pipe with a set of cutting saws between each pair of transporting chains so that the transporting means backs up the pipe when it is being slitted.

Another object is as above and in addition the transporters are relatively long so that a relatively large number of saws can be used in each set or gang which enables an increase in the production of slitted pipe.

A further object is to control the transporting means accurately so that the slitting saws will cut their slits where desired usually at the bottom of the corrugated groove.

An object also is to use a one revolution clutch to operate the transporting means and a one revolutiion clutch to operate the saw carriers.

Again it is an object to control the transporting operation and the slitting operation so that each operation is completed before the other can start and also so that the complete operation is automatic.

Also each transporter and each set of slitting saws is adjustable towards and away from the machine axis so as to accommodate a range of different diameters of pipe.

Another object is to use an odd number of transporters so that one is located diametrically opposite each set of saws to more effectively back up the pipe for the sawing operation.

Other objects of the invention will be more apparent from the following description when taken in connection with the accompanying drawings illustrated a preferred embodiment thereof in which:

FIG. 4 is a sectional view taken on line 4—4 of FIG. 1;

FIG. 5 is a plan view of a saw carrier;

FIG. 6 shows the control circuit diagrammatically;

FIG. 9 is an enlarged view of a prong secured to the transporter.

Figures 1, 7, 8:
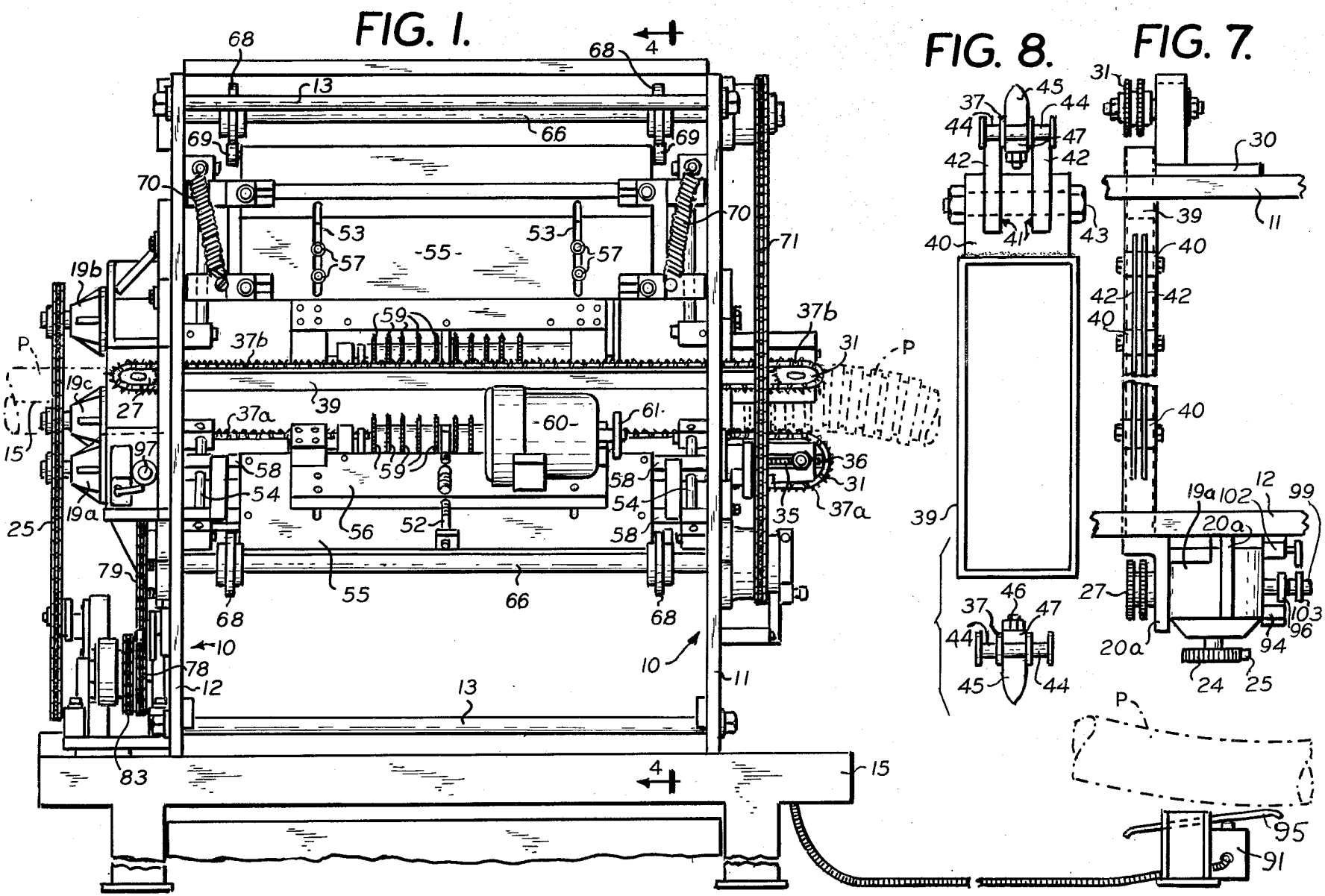
FIG. 1 is a front view of the slitting machine.
FIG. 7 shows a transporter back-up means.
FIG. 8 is an enlarged sectional view of the transporter back-up means.

The slitting machine includes a frame 10 of suitable construction that shown having spaced side plates 11 and 12 secured together by rods 13. Each plate has a hole 14 at or about centrally of the machine through which the pipe P to be slitted passes. A line through the center of the holes provides a machine axis 15. Each plate has a transporter slot 16 for each transporter extending from the hole and extending radially with respect to the machine axis 15. The frame may be mounted on a stand 17 which may form a part of the frame.

Transporting means feeds the pipe P through the machine which includes a plurality of endless transporters, or at least two for smaller diameter pipe where space is limited, with three being shown for larger diameter pipe although there may be more as desired and as space will allow. The outer face of the side plate 11 carries a gear box for each transporter so in the machine illustrated there are three boxes **19*a*, 19*b* and 19*c*. Each gear box is carried by a bracket 20*a*, 20*b* and 20*c* respectively and each of which is secured to the side plate by bolts 21. A plurality of spaced bolt holes 22 in the plates and slots 23 in the bracket enable each bracket and its gear box to be adjusted radially with respect to the machine axis 15 for pipe of different diameters. This axis is the axis of the pipe also as it passes through the machine. Each gear box has a driven sprocket 24 and these three sprockets are connected together by a transporter drive chain 25. This chain meshes with a driving sprocket 26. Each gear box has a transporter sprocket or wheel 27.**

The outer face of the side plate 11 of the frame carries angularly located brackets **30*a*, 30*b* and 30*c* or one for each transporter. These brackets are in alignment with their respective cooperating brackets 20*a*, 20*b* 20*c*. Each bracket carries a transporter sprocket or wheel 31. Each bracket is secured to the plate 11 by bolts 32 passing through slots 33 and spaced bolt holes 34 are provided in the side plate of the frame so as to enable adjustment of these brackets and sprockets radially with respect to the machine axis 15 to accommodte a wide range of different sizes of pipe. Suitable transporter tightening means is provided for each sprocket 31 which includes a slot 35 for the sprocket mounting and a tightening screw 36. A transporter 37*a*, 37*b* and 37*c* is mounted on each pair of sprockets 27 and 31** and is a triple roller chain hence the sprockets are double with one engaging in each other section of the chain.

A back-up means, FIG. 7 and 8, extends between each pair of cooperating brackets 20 and 30 and in line with the transporter and its sprockets to back-up the inner span of the transporter which is the span nearest to the machine axis. The back-up means assures a straight inner transporting span between its sprockets or at least for the sawing span. The back-up means includes a suitable supporting bar 39 which may be a rectangular tube with each end suitable supporting bar 39 which may be a rectangular tube with each end suitably secured to its bracket. This tube fits within the radial slots 16 in the frame plates. A series of track brackets are secured to an edge face of the bar and each bracket has track means shown as a pair of spaced grooves 41 in each of which a rail 42 is clamped by a bolt 43. With a triple roll chain 37 as a transporter the outer rolls 44 of the inner span which is nearest to the machine axis 15 ride on or engage the rails and back-up the transporter. With the ends of the rails spaced from the sprockets and with the rails located radially inwardly of the periphery of its sprockets, a taper is provided for the entry end of the transporter so that the pipe can adjust itself to the transporter. The exit has a similar taper. The transporter or chain has spaced projections 45, FIG. 9, on the outer face thereof so that on the inner span they extend radially inwardly towards the axis to provide a driving connection between the transporters and the pipe P with the projections engaging within the grooves of the pipe.

A one revolution clutch 50 drives all transporters in the same direction and at the same speed. This clutch is well known and is released by a transporter solenoid 51, FIG. 6. Since accuracy is necessary in locating the grooves of the corrugations of the pipe opposite the slitting saws, the one revolution clutch is of the known type which has a positive stop feature (not shown) such as a taper finger pressed into a taper slot which assures that there will be precisely 360° of rotation of the clutch and without any over-run or short-run thereof.

The slitting means, FIG. 1 and 5, includes saw sets usually equal in number to the number of transporters and located between each pair of transporters. Each of the slitting means is identical and includes a saw carrier mounted on slide means extending radially with respect to the machine axis and includes a pair of slides or guides 54, one being carried on the inner face of each frame plate 11 and 12. Preferably the carrier comprises a slide plate 55 and a saw plate 56 adjustable on the slide plate by means of bolts 57 engaging in a slot 53 in the slide plate and an adjusting screw 52. The slide plate has arms 58 on opposite edges which slidably receive the slides. The saws 59 of each set may be driven by its own motor 60 mounted on the saw plate and connected with its saw arbor 63 and the saws thereon by pulleys and a belt 62. The saws may be spaced apart to saw slits in each groove or alternate grooves or every third groove, et cetera, by using spacing washers of suitable width between saws. It is apparent too, that one set of saws may be located to cut slits in one set of three grooves, the second set slits the adjacent grooves and the third set slits every third groove. Other variations are obvious.

Figure 2:
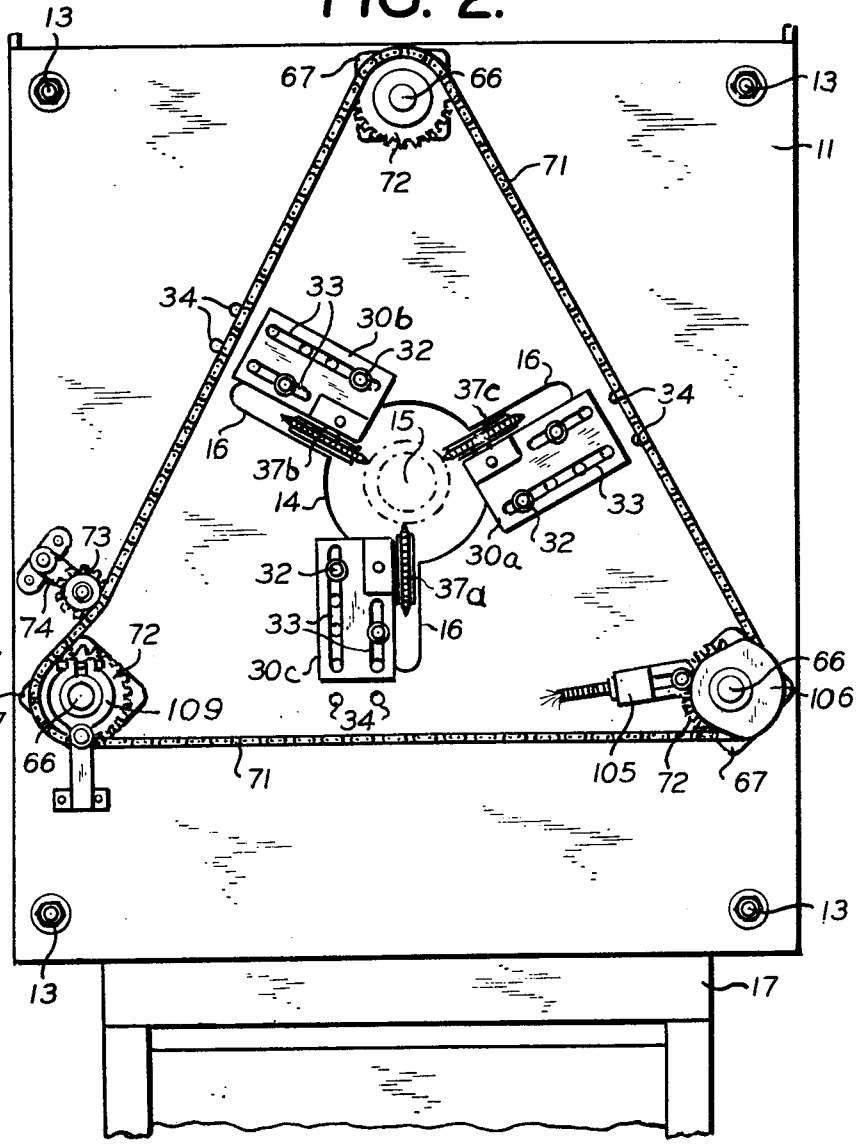
FIG. 2 is a view of the drive end of the machine.

Carrier operating means is provided, FIGS. 2 and 4, to move each carrier on its slides 54 and its saws radially towards and away from the machine axis and pipe P. This means shown for accomplishing this movement is a cam and spring means for each carrier. A cam shaft 66 is journalled in bearings 67 carried by the side plates adjacent to the outer or back edge of each carrier. The shafts 66 are spaced equidistant from each other and the axis 15, so that each carrier may be identical. A pair of spaced cams 68 are secured to each shaft, each of which engages a cam roller 69, FIG. 5, on the carrier to propel each of the latter radially inwardly to bring the saws into contact with the pipe and slit the same. Spring means shown as a pair of coiled springs 70 propels the carrier radially outwardly away from the pipe and axis after the completion of the cutting. A spring is provided on each side of the carrier and each has one end secured to the frame and its outer end secured to the carrier. This operating means could well be a grooved cam or eccentric means to move the carrier both inwardly and outwardly or the operation of the cam means and spring means could be reversed so that the springs propel the carriers inwardly to make the cut and the cams propel the carrier outwardly to its retracted position. The cam shafts are driven by a chain 71 meshing with a sprocket 72 on each cam shaft. A chain tightener is provided by an idler sprocket 73 mounted on a pivoted arm 74.

Figure 3:
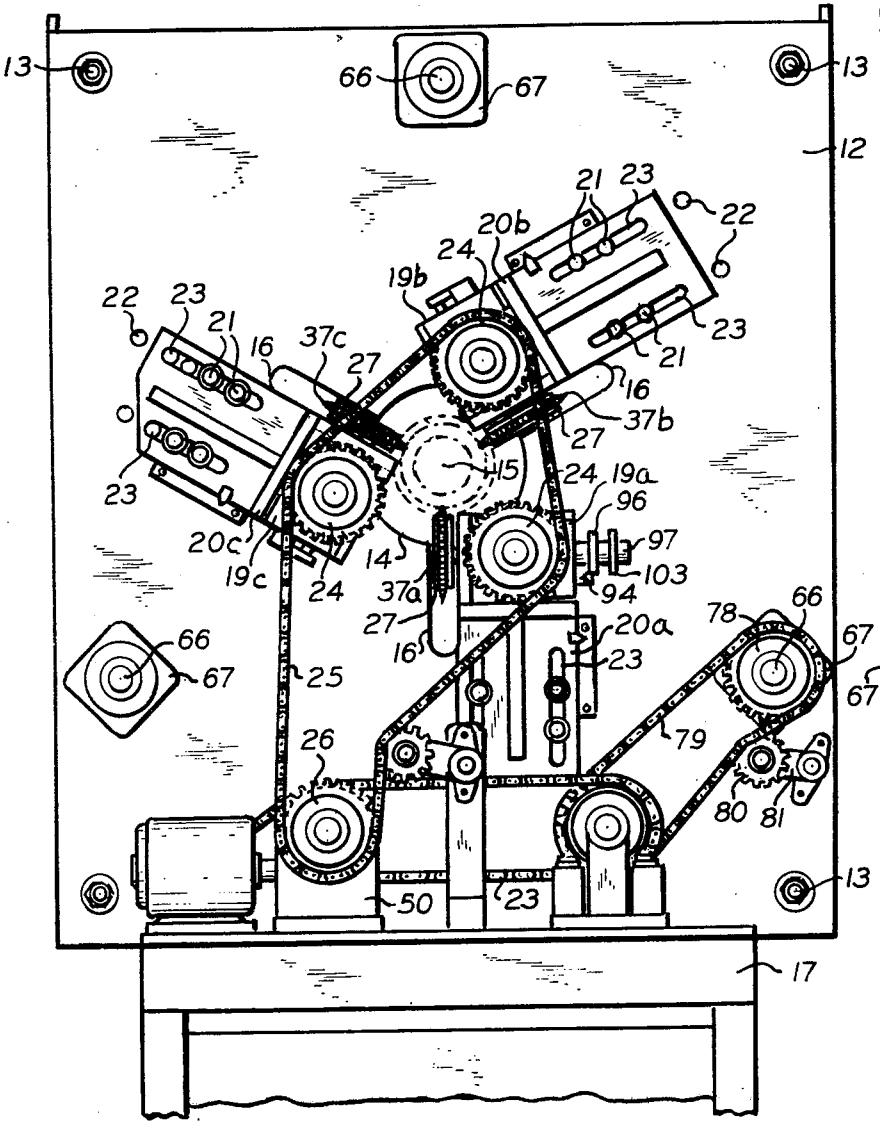
FIG. 3 is a view of the cam shaft drive end of the machine.

The saw carrier operating means, FIG. 3, includes a one revolution clutch 77 which is connected with one of the cam shafts 66 by sprockets 78 and a chain 79. A chain tightener includes a sprocket 80 on a pivoted arm 81. The two, one revolution clutches are driven by a single motor M connected by a chain 82 to clutch 50 and a chain 83 between clutches and having suitable sprockets. operation of the clutch 77 is initiated by a carrier solenoid 76.

Control means initiates each of the two operations of transporting the pipe and slitting of the pipe. In order to prevent inadvertent simultaneous or overlapping operation there are protective elements in the control means so that this cannot occur, that is one operation cannot begin or function until the other is completed or substantially completed. Preferably the control means is at least partially automatic with the transporting means, when it has substantially completed its operation, initiating the operation of the slitting means. Desirably the control means is fully automatic with the sag in the pipe between extruder and the slitting machine initiating the transporting operation and the next cycle.

The transport control means for the one revolution clutch 50, FIG. 6, is engaged to make its one revolution by energizing its solenoid 51 which pulls the lever 81 away from the clutch shoulder. In order to assure that this clutch is not actuated so long as any of the saw carriers is not in retracted position, a switch 87, FIG. 5, is provided for each carrier and operated thereby, such as by the shoulder of an arm 58. On the initial movement of each carrier from retracted position, its switch is opened and closes on the last short movement of the carrier to fully retracted position. These three switches are connected in series with each other and prevent energizing of the solenoid 51 so that operation of transporters cannot take place until the slitting operation is completed. The failure of any one or more carriers to return to retracted position would prevent the transporting mean from being operated. The complete control circuit for releasing the clutch 50 for the transporters includes a starting switch 88, wire 89, closed switch 90, normally closed contacts C2, an initiating or pipe switch 91 which is closed by the sag in the pipe P engaging lever 95, switches 87 and relay TR to ground. Energization of the relay TR closes normally open contacts Tl which completes a circuit from junction 92, through normally closed contacts C1, now closed contacts Tl and solenoid 51. Energization of relay TR also closes a holding circuit including wire 93, a cam operated timing switch 94, normally open but now closed contacts T2 to junction 92, contacts Cl, Tl, solenoid 51 to ground. Opening of pipe switch 91 does not affect this transport holding circuit.

The slitting control means for the slitting operation which energizes solenoid 76 for release of clutch 77 is connected so that the saw motors S and their saws are rotating before this circuit is energized through closing of a manual switch 98. Closing of a manual switch 99 which is in series with switch 98 energizes a circuit including wire 100 in which is a normally open trigger switch 102 and solenoid 76. Switch 102 is closed by some part of the transporting means and conveniently by a cam 103 carried on a shaft 97 of one of the gear boxes and has an operating land of 340° to hold the switch open for most of the transport operation and closes during the last 20° rotation thereof after which it again opens. This cam and switch 102 automatically initiates or triggers the sawing or slitting operation at the end of the transporting operation.

Timing switch 105 is operated by a cam 106 carried on a cam shaft 66 and conveniently is a 180° cam although it could be of greater or lesser extent. This cam will hold switch 104 closed for half or about half of the saw cutting operation. Preferably the cam is positioned on the shaft 66 so that switch 104 is closed for 90° from the start of the slitting operation, is opened for the next 180° and closed again for 90° and remains closed for the next cycle. Opening of switch 105 breaks the hold circuit for relay CR which opens contracts C3. This hold circuit holds the saw clutch solenoid 76 energized for a sufficient length of time after switch 102 opens at the end of the transport operation. Although switch 102 closes 20° before the end of the transporting operation, in this short time the saw carriers have just started to move towards the pipe.

For complete automatic control of the machine, the pipe switch 91 is provided which is closed by a pivoted plate 95. This switch is located between the slitting machine and the pipe extruding machine. As the pipe sags between the two machines, because of the continuous extruding of the pipe and the intermittant transporting of the pipe through the slitting machine, the pipe closes switch 91 and the slitting machine goes through its cycle transporting and slitting. The more efficient operation is to have the cycle of the slitting machine equal to or slightly less than the speed of the continuous extrusion of the pipe so that with this timing the slitting operation is completed and there is a slight delay until there is enough sag in the pipe to engage lever 95 and close switch 91. The slitting machine will operate at a speed of about 40 to 50 feet per minute.

There will be occasions when it is desired to operate the transporters without going through the slitting operation. The circuit provides for this in a circuit including switches 112 and 113 connected in series, to shunt switch 90, contacts C2 and switch 91, and connected with junction 92. Switch 90 is ganged with switch 112 so that closing of switch 112 opens switch 90. Closing of manual or initiating switch 113 completes a circuit through wire 89, switches 112, 113, 87, the three switches and relay TR which closes contacts Tl and completes the circuit through contacts Cl, Tl and solenoid 51 to release transporter clutch 50. Holding circuit through wire 93, switch 94, now closed contacts T2 to junction 92 is completed as well. The holding circuit is opened by opening of switch 94 by cam 96 as described. With switch 99 open the slitting operation is not performed and a second operation of the transporting means can be initiated by again closing switch 113. Switch 99 may be and preferably is ganged with switches 90 and 112 to open switch 99 upon closing of switch 112.

There are protective elements in the control circuits which prevent simultaneous or overlapping operation of the transporting means and slitting means. The switches 87 in the transport circuit are such elements. The contacts T3 in the slitting circuit which open on operation of the transporting means and energization or relay TR assures that the slitting operation means cannot operate so long as this relay is energized and the transporting means is running. Contacts C1 and C2 in the transporting circuit are protective elements also in that they open so long as relay CR is energized during the slitting operation.

In order to reduce or eliminate torque on the pipe from the saws when the machine has an even number of sets of saws, half of the sets will have the saws rotating in one direction and half in the opposite direction. When there is an odd number of saw sets there will be one saw more rotating in one direction than in the other direction.

The 180° cam 106 is illustrated in a position such that the switch 105 opens upon a 90° rotation or upon one fourth of the slitting operation. The 180° cam 96 is illustrated in a position such that the switch 94 is closed for 180° rotation or half of the transporting operation. Cam 106 may be adjusted on its shaft 66 so that switch 105 opens upon completion of some other portion of the slitting operation up to 180°. Similarly cam 96 may be adjusted on its gear box shaft 99 so that switch 94 opens upon completion of some other portion less than 180° or half of the transporting operation. It is clear that the operating lands of these cams may be increased or decreased as desired.

The simplest form of control is one in which each operation is initiated by a manual switch, for example the closing of a manual switch such as 113, sets the transporting means into operation. Similarly by eliminating automatic trigger switch 102, the slitting operation can be controlled by the manual switch 99. In this form of control, the switches 87 and contacts C1 and T3 would prevent overlapping of operations. A partial automatic control means would retain trigger switch 102 but dispense with pipe swich 91 in which circuit the attendant would decide when there was enough sag in the pipe to start a cycle of transporting and slitting. The fully automatic control means particularly disclosed is the more advantageous and efficient control. If desired, switch 99 an be opened whereupon the pipe may be transported without slitting. Closing of switch 99 restores the transporting and slitting operations leaving a section of the pipe without slits. If there is no pipe passing through the machine then the transporting means alone can be operated by opening switch 98, closing switch 112 and opening switch 90 and manually closing switch 113. The transporting operation without pipe can be secured also by leaving switches 90, 112 and 113 as illustrated and step on or depress lever 95 to close switch 91.

For pipes of smaller diameter there is not enough room for more than two transporters and two sets of carriers. With this construction the transporters are located 180° apart and a rail or pipe guide is provided on each side between the transporters and engaging the periphery of the pipe to retain the pipe on the machine axis. These pipe guides preferably are located at 90° from the transporters. Each saw set is opposite from the other and is positioned to slit the pipe between a pipe guide and a transporter.

A brake 109 may be provided which is on constantly and engaged relatively lightly to bring each operation to a halt more quickly. It can be adjusted as desired.

This invention fills a need for improvements in a Pipe Slitting Machine. Various modifications may and often do occur to those skilled in the art, especially after benefitting from the teachings herein. The preferred means of embodying the invention is useful form is disclosed.

What is claimed is:

1. A slitting machine for a corrugated pipe with the machine and pipe having the same axis comprising a frame, transporting means including at least two endless transporters, spaced mounting means carried by the frame and mounting each transporter uniformly spaced angularly with respect to each other and with reference to the axis, each transporter having an inner span with at least a major portion of the length thereof parallel to each other and the axis and straight, the straight span of each transporter being spaced from the axis a distance to engage the periphery of the pipe to support the same, each transporter having projecting means directly inwardly towards the axis for the inner span and spaced apart so as to enter an inwardly directed corrugation of the pipe, transporter operating means operatively connected with the transporters to drive the same in the same direction and at the same speed, slitting means positioned between each pair of transporters and directed radially inwardly with respect to the axis including slide means carried by the frame uniformly positioned angularly with respect to each other, a saw carrier mounted on each slide means for radial movement toward and away from the machine axis and having an inner edge and an outer edge, a plurality of circular saws forming a set mounted in alignment on each carrier at the inner edge thereof and spaced apart to cut into a separate corrugation of the pipe, saw motor means for each set of saws carried on its saw carrier and connected with its saws to rotate the same, carrier operating means connected with its saws to rotate the same, carrier operating means connected with each of the carriers to move the same radially inwardly towards the axis to sawing position and outwardly to retracted position with respect to the axis, transporter control means connected with the transporter operating means to operate the same, and slitting control means connected with the carrier operating means to operate the same.

2. A slitting machine as in claim 1 in which the transporter operating means includes a one revolution clutch, the transporter control means being connected with its clutch to engage the same, and the carrier operating means includes a one revolution clutch, and the slitting control means being connected with its clutch to engage the same.

3. A slitting machine as in claim 1 in which the carrier operating means includes cam means for each carrier and engaging the same to move the carrier in one direction and spring means operatively connected with each carrier to move the same in the opposite direction.

4. A slitting machine as in claim 3 in which the cam means is located at the outer edge of each carrier and engaging the same to propel the carrier and its saws inwardly towards the axis, and the spring means being connected with its carrier to propel the same outwardly to retracted position.

5. A slitting machine as in claim 3 in which the carrier operating means includes a one revolution clutch, the carrier control means being connected with its clutch to engage the same, the transporting operating means includes a one revolution clutch, and the transporter control means being connected with its clutch to engage the same.

6. A slitting machine as in claim 1 in which the saw carrier includes a platform, a saw plate, means adjustably securing the saw plate to the platform, the saws being carried on the saw plate, and means adjustably mounting each transporter on the frame.

7. A slitting machine as in claim 1 including back-up means for each transporter engaging the inner span thereof to retain the same in a straight line between its mounting means.

8. A slitting machine as in claim 7 in which each back-up means includes track means to guide the inner span of the transporter thereon and prevent sag and lateral displacement thereof.

9. A slitting machine as in claim 8 in which the track means includes a pair of spaced rails, and a plurality of collars carried at spaced intervals on the transporter engaging between the rails.

10. A slitting machine as in claim 9 in which each projecting means carried by each transporter carries the collar.

11. A slitting machine as in claim 6 in which the frame has a central hole, the adjustable mounting means for each transporter including slot means in the frame extending radially from the hole, and means securing each transporter mounting means in adjusted position.

12. A slitting machine as in claim 11 in which the mounting means for each transporter includes a pair of spaced brackets each having a mounting wheel to receive the transporter, a back-up means secured to the pair of brackets having a dimension to be received in the slot means, and the back-up means engaging the inner span of the transporter to support the same.

13. A slitting machine as in claim 7 in which the carrier operating means includes cam means for each carrier and engaging the same to move the carrier in one direction, and spring means operatively connected with each carrier to move the same in the opposite direction.

14. A slitting machine as in claim 2 including means interconnecting the transporter control means and the slitting control means to operate each clutch only after completion of the operation of the other operating means.

15. A slitting machine as in claim 3 including a back-up means for each transporter engaging the inner span thereof to retain the same in a straight line.

16. A slitting machine as in claim 1 in which the transporter operating means including a one revolution transporter clutch, and the transporter control means includes a solenoid operatively connected with the transporter clutch to engage the same, an initiating switch, a switch for each carrier operated by the latter to open position by the initial radial movement inwardly of the carrier and closed upon its return to retracted position, and the initiating switch and the carrier switches being connected in series and controlling the energizing of the solenoid to prevent operation of the transporter clutch until all carriers are in retracted position.

17. A slitting machine as in claim 16 including a transporter relay in series with the initiating switch and carrier switches, the relay having normally open contacts, a solenoid circuit including the transporter solenoid and the contacts which are closed upon energization of the relay, and the solenoid circuit shunting the carrier switches and the relay.

18. A slitting machine as in claim 17 including a relay holding circuit shunting the initiating switch and having normally open contacts which are closed by energization of the transporter relay, and a normally closed switch in the holding circuit which is opened by the transporter operating means.

19. A slitting machine as in claim 2 including a carrier solenoid connected with the carrier clutch to engage the same, and a normally open carrier initiating switch connected in series with the carrier solenoid and closed by the transporter operating means at the end of the operation of the transporters.

20. A slitting machine as in claim 19 including a carrier relay shunting the carrier solenoid and having normally open contacts which are closed on energization of the relay, a holding circuit shunting the carrier initiating switch including the relay contacts and a normally closed switch connected in series and connected with the carrier operating means to be opened thereby and deenergize the carrier solenoid.

21. A slitting machine as in claim 16 in which the carrier operating means includes a one revolution carrier clutch, a carrier solenoid connected with the carrier clutch to engage the same, a normally open carrier initiating switch connected in series with the carrier solenoid and connected with the transporter operating means to be closed at the end of the operation of the transporters.

22. A slitting machine as in claim 18 in which the carrier operating means includes a one revolution carrier clutch, a carrier solenoid connected with the carrier clutch to engage the same, a normally open carrier initiating switch connected in series with the carrier solenoid and connected with the transporter operating means to be closed at the end of the operation of the transporters, a carrier relay shunting the carrier solenoid and having normally open contacts which are closed on energization of the carrier relay, a holding circuit shunting the carrier initiating switch including in series the relay contacts and a normally closed switch connected with the carrier operating means to be opened thereby and deenergize the carrier solenoid.

23. A slitting machine as in claim 22 in which the transporter relay includes a second set of normally open contacts in the transporter holding circuit, and a third set of normally closed contacts in the carrier holding circuit, the carrier relay having a second set of normally closed contacts in series with the transporter solenoid, and a third set of normally closed contacts in series with the initiating switch for the transporter control circuit.

* * * * *

UNITED STATES PATENT OFFICE

CERTIFICATE OF CORRECTION

Patent No. 4,000,672 Dated January 4, 1977

Inventor(s) Theodor K. Sitterer et al.

It is certified that error appears in the above-identified patent and that said Letters Patent are hereby corrected as shown below:

Column 1, line 12, after "sawing" insert -- position --.

Column 7, line 13, "directly" should read -- directed --.

Column 7, lines 30 and 31, delete "carrier operated means connected with its saws to rotate the same".

Signed and Sealed this

Nineteenth Day of April 1977

[SEAL]

*Attest:*

RUTH C. MASON
*Attesting Officer*

C. MARSHALL DANN
*Commissioner of Patents and Trademarks*